US006796837B2

(12) United States Patent
Fukatsu et al.

(10) Patent No.: US 6,796,837 B2
(45) Date of Patent: Sep. 28, 2004

(54) CONNECTOR WITH LOCK PIECE THAT LONGITUDINALLY DEFORMS

(75) Inventors: Yukihiro Fukatsu, Yokkaichi (JP); Kiyofumi Ichida, Yokkaichi (JP); Shinya Fujita, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 10/606,541

(22) Filed: Jun. 26, 2003

(65) Prior Publication Data

US 2004/0002259 A1 Jan. 1, 2004

(30) Foreign Application Priority Data

Jun. 28, 2002 (JP) ..... 2002-190714

(51) Int. Cl.[7] ..... H01R 13/40
(52) U.S. Cl. ..... 439/595; 439/594; 439/752
(58) Field of Search ..... 439/594–595, 439/752

(56) References Cited

U.S. PATENT DOCUMENTS 5,186,657 A 2/1993 Abe ..... 439/595
5,235,743 A 8/1993 Endo et al. ..... 29/685
6,695,651 B2 * 2/2004 Mase et al. ..... 439/752
6,702,614 B2 * 3/2004 Nakamura et al. ..... 439/595
2002/0187676 A1 * 12/2002 Kurimoto et al. ..... 439/595
2002/0193013 A1 * 12/2002 Mase et al. ..... 439/752
2003/0045180 A1 * 3/2003 Kobayashi et al. ..... 439/752
2003/0054691 A1 * 3/2003 Machida et al. ..... 439/595

FOREIGN PATENT DOCUMENTS

EP 1 094 572 A1 4/2001
EP 1 217 697 A2 6/2002

* cited by examiner

*Primary Examiner*—Michael C. Zarroli
(74) *Attorney, Agent, or Firm*—Gerald E. Hespos; Anthony J. Casella

(57) ABSTRACT

A connector housing (30) has a cavity (31) and a resiliently deformable lock (40) cantilevers forwardly from a wall (35) of the cavity (31) for engaging a locking surface (24) of a terminal fitting (10) inserted into the cavity (31). A base end of the lock (40) has a thinned portion (52). A backward pulling force on the female terminal fitting (10) creates a compressive force on the lock (40) in the longitudinal direction. Thus, the lock (40) undergoes such a resilient deformation at the thinned portion (52) that the length (L1) of the lock (40) becomes shorter than its natural length (L0). Buckling strength is enhanced by as much as the lock (40) is shortened and, as a result, a force for locking the female terminal fitting (10) is enhanced.

14 Claims, 11 Drawing Sheets

CONNECTOR WITH LOCK PIECE THAT LONGITUDINALLY DEFORMS

BACKGROUND OF THE INVENTION

1. Field of the Invention

The invention relates to a connector to enhance a locking force of a lock.

2. Description of the Related Art

U.S. Pat. No. 5,235,743 discloses a connector with a housing that has a cavity and a lock that cantilevers forwardly from a side wall of the cavity. A terminal fitting is inserted into the cavity from behind and resiliently deforms the lock. The lock is restored resiliently and engages the terminal fitting when the terminal fitting is inserted sufficiently. Thus, the lock prevents the terminal fitting from coming out.

There have demands to miniaturize connectors in recent years and, accordingly, terminal fittings and cavities are formed smaller. As a result, locks have been formed narrower. There is a possibility that a narrower lock will deform relatively easily and buckle or break due to a pulling force on the wire and the terminal fitting.

In view of the above problem, an object of the invention is to enhance a locking force of a lock.

SUMMARY OF THE INVENTION

The invention is a connector with a housing and at least one cavity in the housing. A lock cantilevers from a side wall of the cavity. A terminal fitting is insertable into the cavity from behind and deforms the lock. However, the lock then is restored resiliently to engage the terminal fitting when the terminal fitting is inserted by a specified distance. The lock comprises a deformation permitting portion for permitting a resilient deformation such that the length of the lock becomes shorter or the lock undergoes a buckling or deforming motion when a compressive force acts on the lock along a direction substantially opposite to the inserting direction.

A force may act on the terminal fitting in a withdrawing direction while the terminal fitting is engaged with the lock. Thus, a compressive force acts on the lock substantially in the longitudinal direction. However, the lock undergoes a resilient deformation so that the lock becomes shorter by a function of the deformation permitting portion. Buckling strength is enhanced by as much as the lock is shortened and, as a result, a force for locking the terminal fitting is enhanced. This is suitable in miniaturizing the connector.

The lock preferably is restored so the leading end of the lock engages and locks the terminal fitting.

The deformation permitting portion preferably comprises a thinner portion at a selected location along the longitudinal direction of the lock.

The lock bends at the thinner portion when the compressive force acts substantially along the longitudinal direction of the lock. As a result, the lock is deformed resiliently to become shorter.

A locking projection preferably is formed on a side of the terminal fitting substantially facing the lock to increase an area of engagement with the lock. The lock preferably is recessed to form an insertion groove that permits the passage of the locking projection when the terminal fitting is inserted and resiliently deforms the lock. The deformation permitting portion is formed by making the insertion groove deeper at one part along the longitudinal direction.

The lock bends at the deeper part of the insertion groove when the compressive force acts on the lock in the longitudinal direction. Thus, the lock deforms resiliently and becomes shorter.

The insertion groove may be formed deeper by setting an inclination of a bottom of the insertion groove slightly steeper than that of a surface of the lock substantially opposite to the surface where the insertion groove is formed.

The deformation permitting portion preferably comprises a portion having a reduced cross-sectional area.

The deformation permitting portion preferably is at a base of the lock where the lock projects from the side wall substantially in the inserting direction.

A bent portion of the deformation permitting portion preferably contacts a corresponding portion of the side wall so as to strut the lock thereon when a compressive force acts on the lock substantially along the longitudinal direction. Accordingly, a locking force of the lock can be displayed reliably and enhanced.

The terminal fitting preferably is formed at a wall substantially facing the lock with a cut-away portion for engaging the lock. Sections of the wall before and behind the cut-away portion are coupled via a coupling portion at one side of the wall and the lock comprises an escaping portion for the coupling portion.

These and other features and advantages of the invention will become more apparent upon reading of the detailed description of preferred embodiments and the drawings. Even though embodiments are described separately, single features may be combined to additional embodiments.

DETAILED DESCRIPTION OF THE PREFERRED EMBODIMENTS

A female connector according to a first embodiment of the invention is described with reference to FIGS. 1 to 9. In the following description, a mating side of the female connector with a mating male connector is referred to as the front side.

Figure 1:
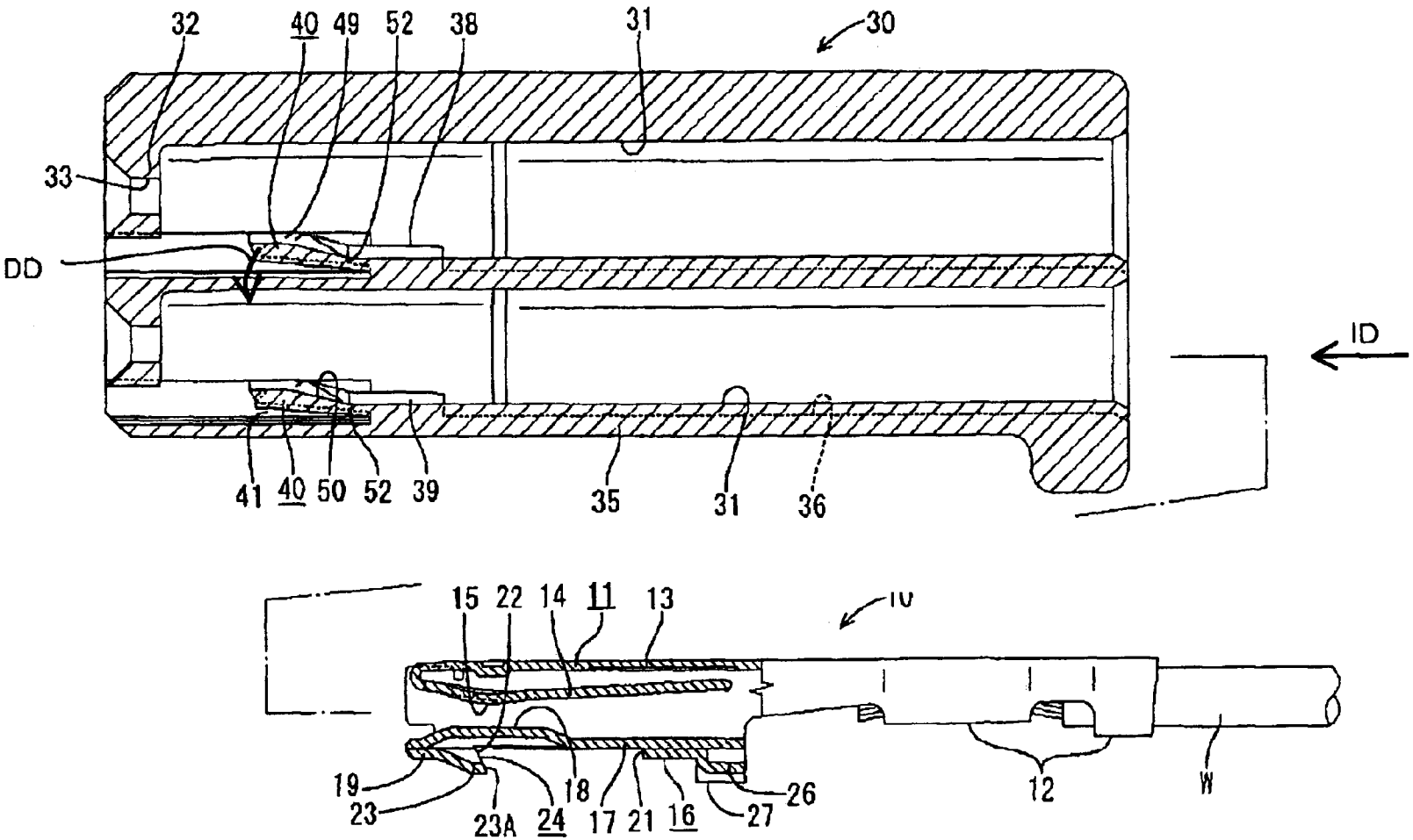
FIG. 1 is a side cross-sectional view showing before female terminal fittings are inserted into a female housing of a first embodiment of the invention.
Figure 2:
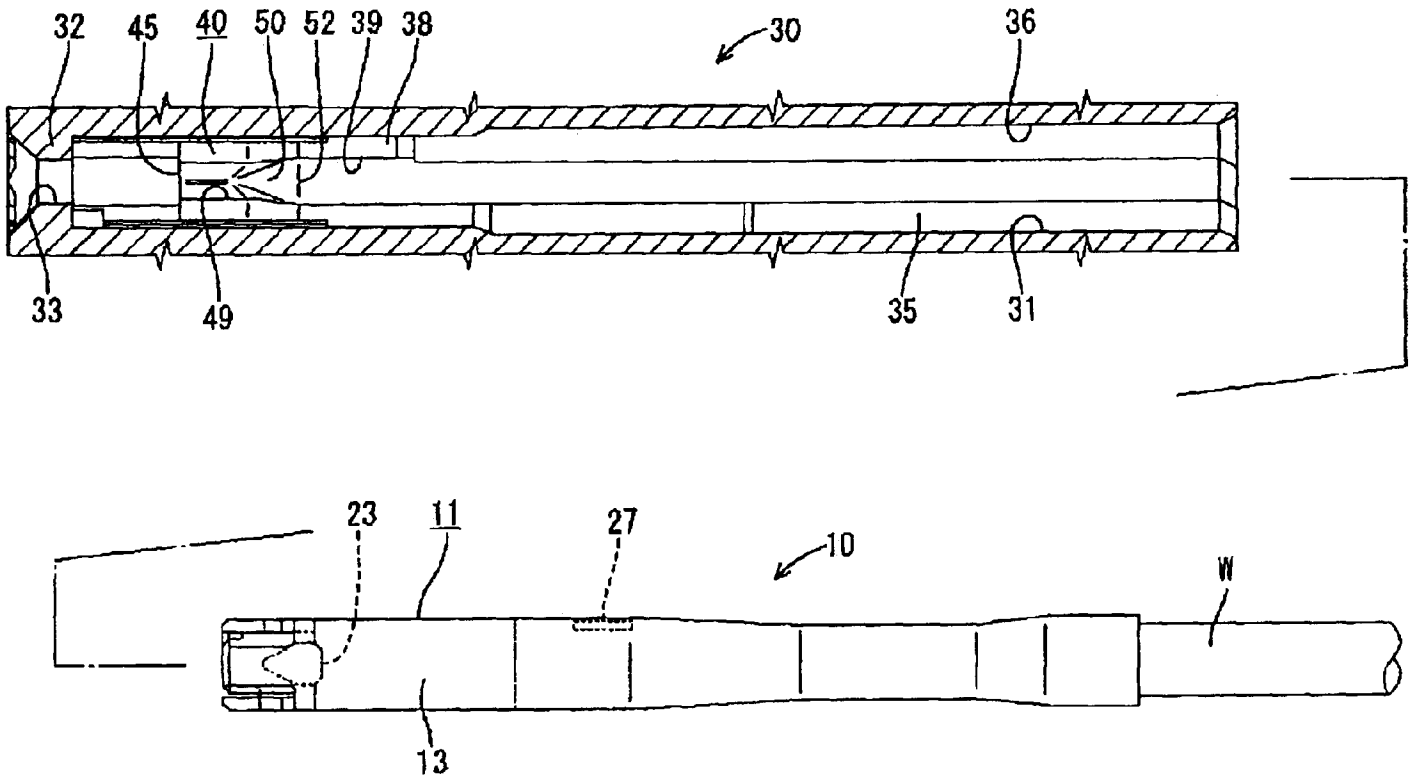
FIG. 2 is a plan view in section showing the state of FIG. 1.
Figure 3:
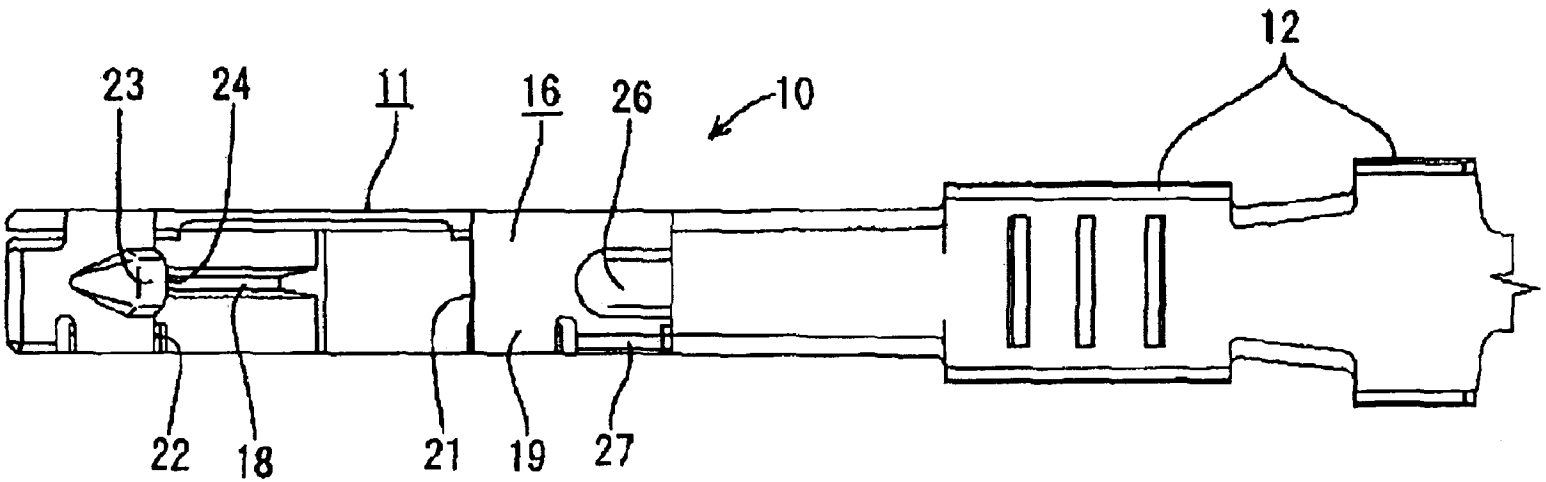
FIG. 3 is a plan view of the female terminal fitting.
Figure 4:
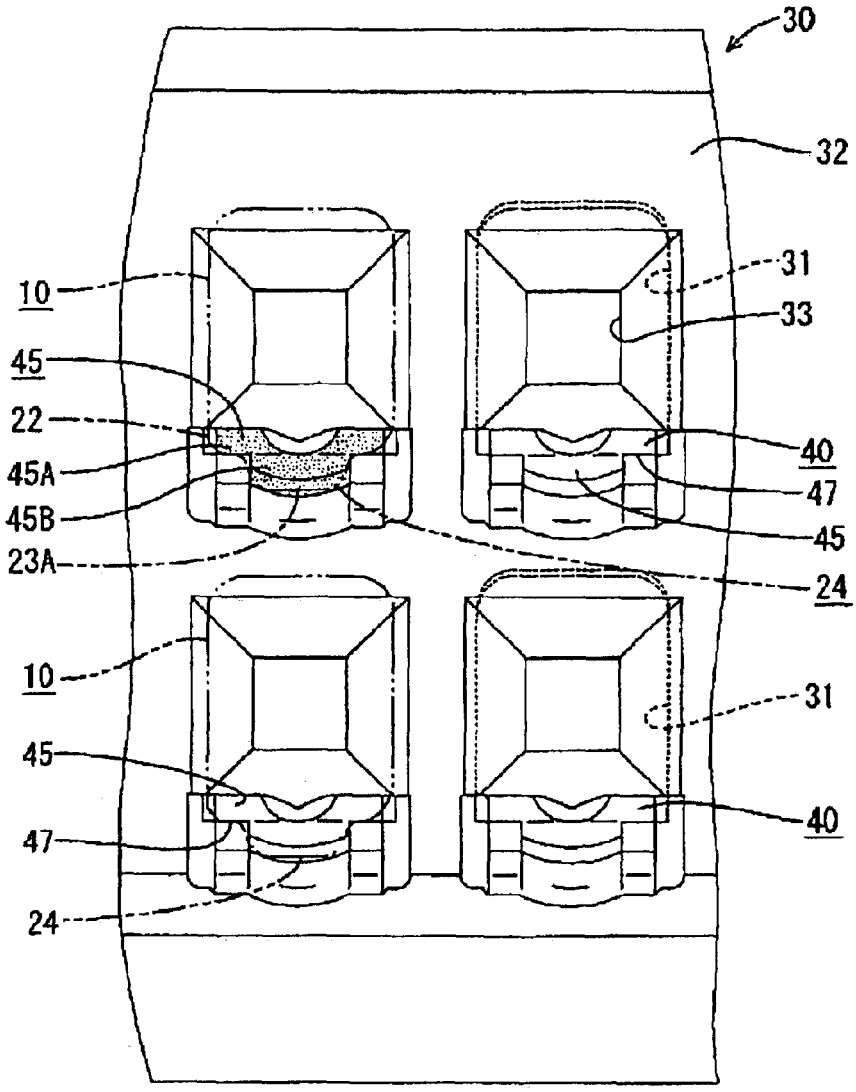
FIG. 4 is a partial front view of the female housing.

The connector includes a female terminal fitting identified by the numeral 10 in FIGS. 1 to 3. The female terminal fitting 10 is formed by pressing, folding, embossing, cutting or stamping out a metallic plate having an excellent electrical conductivity. More specifically, the female terminal fitting 10 includes a rectangular tubular main body 11 that is hollow along forward and backward directions. Barrels 12 are formed behind the main body 11 and are crimped, bent or folded into connection with an end of a wire W.

A tongue-shaped resilient contact piece 14 is folded back at the front end of a bottom wall 13 of the main body 11 and is bent at a large obtuse angle to slope moderately. A contact 15 is formed on a tip of the resilient contact piece 14 for contacting a tab (not shown) of a mating male terminal fitting.

A ceiling 16 is on a side of the main body 11 opposite the resilient contact piece 14. The ceiling 16 has an inner wall 17 that is embossed at a position substantially facing the contact 15 of the resilient contact piece 14 to define a receiving portion 18 for tightly pressing the tab of the male terminal fitting.

The ceiling wall 16 also has an outer wall 19. A cut-away portion 21 is formed over the entire width of the outer wall 19 at substantially the longitudinal middle of the outer wall 19, as shown in FIGS. 1 and 3. The cutaway portion 21 forms a cut front end surface 22 that is embossed to define a locking projection 23 that projects out at a widthwise middle of the front cut end surface 22.

The locking projection 23 is elongated and has a substantially inversely U- or V-shaped cross-section that opens backward. Additionally, the locking projection 23 is tapered toward its front end with respect to widthwise and height directions. A rear end surface 23A of the locking projection 23 and the cut end surface 22 of the cut-away portion 21 are substantially continuous with each other and define a locking surface 24. The locking surface 24 is inclined in an overhanging or undercut manner so that its projecting end bulges out more backward than its base end, as shown in FIG. 1.

An auxiliary locking projection 26 is formed at the rear end of the outer wall 19 of the ceiling 16 and is engageable with an unillustrated retainer for doubly locking the female terminal fitting 10. Additionally, a stabilizer 27 stands at the side of the auxiliary locking projection 26.

The connector also includes a female housing 30. The female housing 30 is made e.g. of a synthetic resin, and cavities 31 are formed at upper and lower stages inside the female housing 30 for receiving the female terminal fittings 10.

A front wall 32 of each cavity 31 functions to stop the corresponding female terminal fitting 10 at a front-limit position, and is formed with a tab insertion opening 33 through which a tab of the mating male terminal fitting is insertable.

Each cavity 31 has a bottom wall 35 formed with a recessed guide groove 36 at the left side when viewed from the front. The guide groove 36 has an open rear end and extends to a position slightly before the longitudinal center of the cavity 31, as shown in FIG. 2. The guide groove 36 is dimensioned and disposed to receive the stabilizer 27 of the female terminal fitting 10.

The bottom wall 35 of each cavity 31 is slightly raised at a position immediately before an area where the guide groove 36 is formed, thereby forming an elevated portion 38, and a lock 40 for locking the female terminal fitting 10 is formed before the elevated portion 38.

Figure 5:
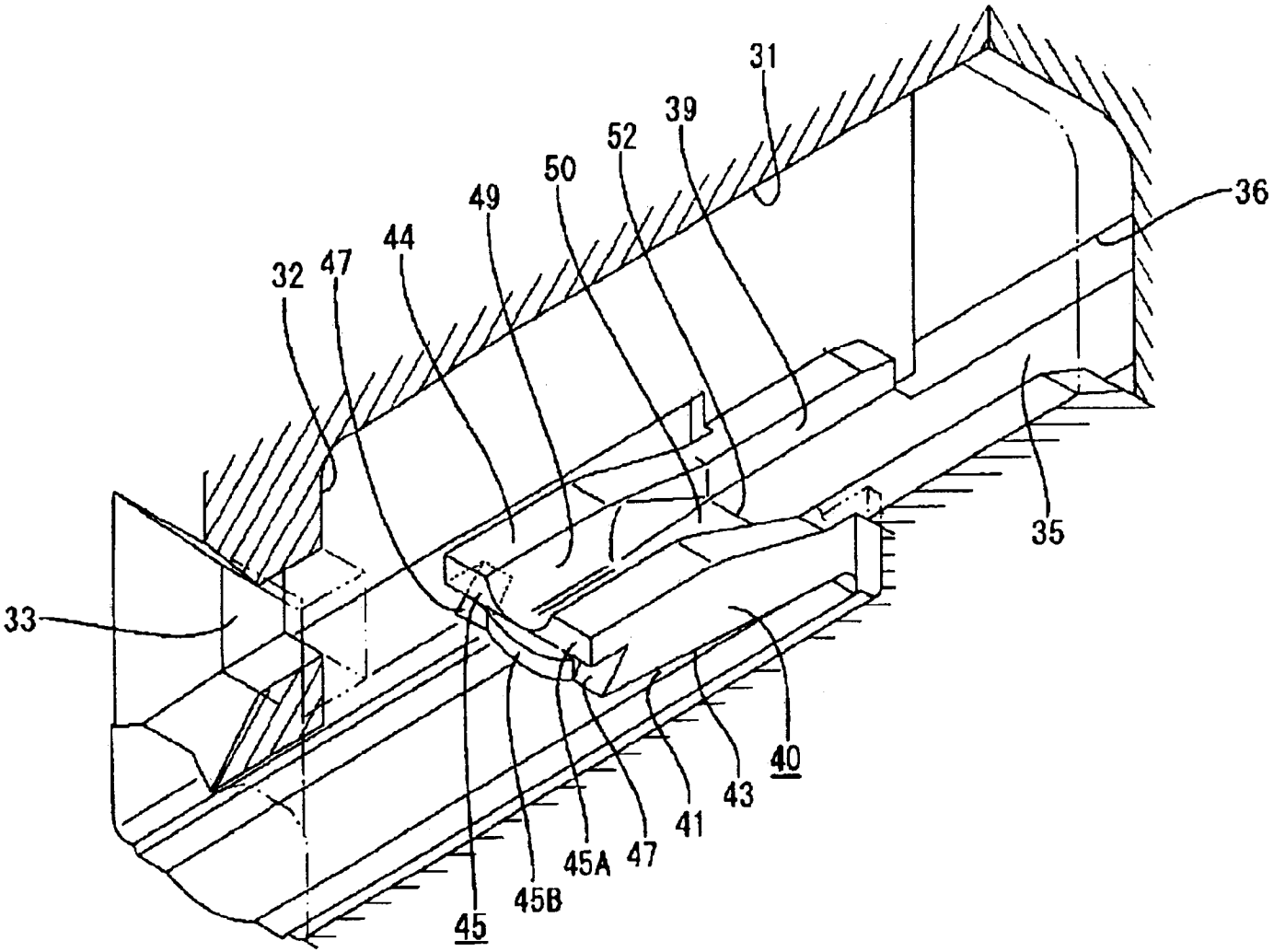
FIG. 5 is a perspective view showing a part where a lock is formed.

The lock 40 is a thick forwardly cantilevered piece that is slightly narrower than the cavity 31, as shown in FIG. 5. A projecting side of the lock 40 is resiliently deformable in a deformation direction DD toward a deformation space 41 below the lock 40. A portion of the cavity 31 before the lock 40 is open for removal of a mold.

Figure 6:
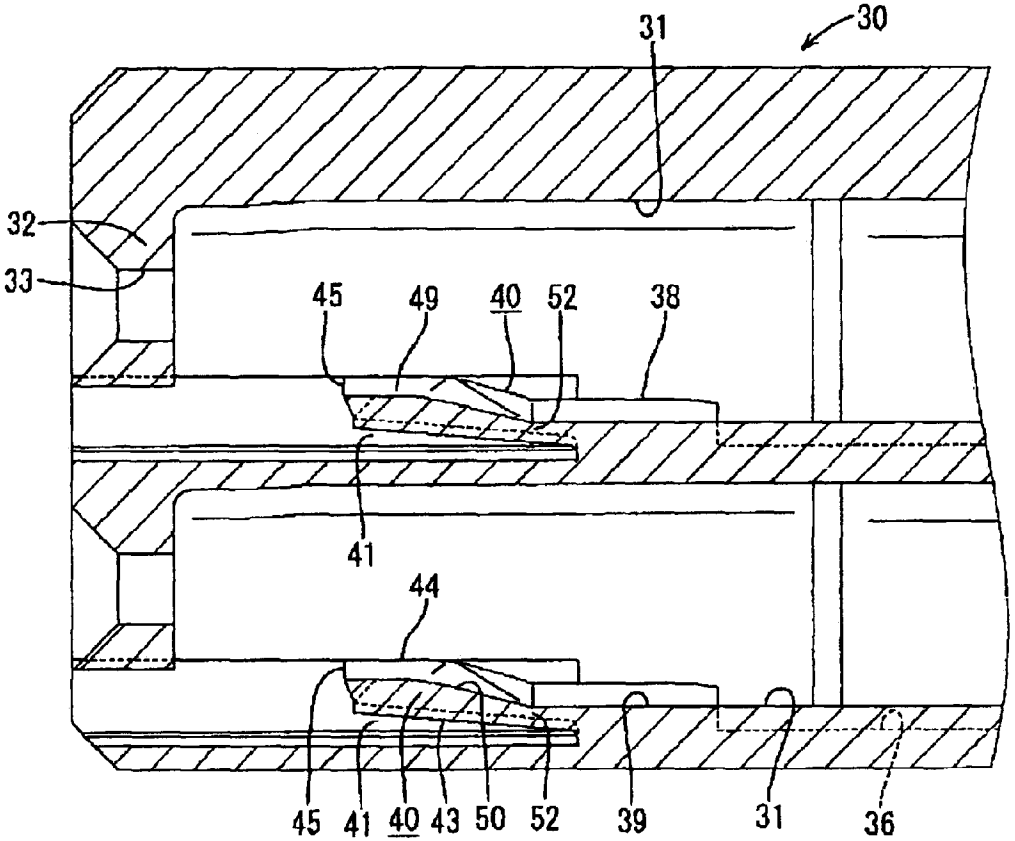
FIG. 6 is a partial enlarged side view in section of the female housing.

The lock 40 has a lower surface 43 that slopes moderately up from its base end toward its leading end, as shown in FIG. 6. The lock 40 also has an upper surface 44 that is sloped slightly more steeply up than the lower surface 43 at the base end. However, the upper surface 44 is substantially horizontal or parallel to the inserting direction ID at its leading end.

The lock 40 has a leading end surface 45 with a shape that substantially conforms to the shape of the locking surface 24 of the female terminal fitting 10. The leading end surface 45 has an upper contact surface 45A that extends over substantially the entire width and a narrower lower contact surface 45B that is substantially continuous with the upper contact surface 45A, as shown by the shaded portion in FIG. 4. The lower surface 43 of the lock 40 is formed to bulge arcuately out at a position substantially corresponding to the width of the lower contact surface 45B.

Jig catching recesses 47 are formed at the opposite sides of the lower contact surface 45B for catching a disengagement jig. Thus, the locking portion 40 can be caught by the jig and forcibly deformed in the deformation direction DD for disengagement from the female terminal fitting 10.

An insertion groove 49 is formed in substantially the widthwise center of the upper surface of the lock 40 for permitting the passage of the locking projection 23 of the female terminal fitting 10. The insertion groove 49 is substantially continuous with an escaping groove 39 formed in the elevated portion 38 of the bottom wall 35 of the cavity 31.

The insertion groove 49 has a bottom 50 that is substantially parallel to the inserting direction ID at its base end, slopes up at its middle, and is substantially parallel to the inserting direction ID again at its leading end, as shown in FIG. 6. Further, as shown in FIG. 2, opposite sides of the insertion groove 49 bulge in at a portion where the bottom 50 slopes up, so that the insertion groove 49 is gradually narrower toward the leading end. The bottom 50 is arcuate at the leading end where it is substantially parallel to the inserting direction ID.

The insertion groove 49 is in the upper surface of the lock 40 as described above. Thus, the lower surface 43 of the lock 40 bulges out arcuately at its widthwise center portion so as to ensure a sufficient thickness.

It should be noted that, upon forming the insertion groove 49, The inclination of the bottom 50 is slightly steeper than that of the lower surface 43 of the lock 40 where the bottom 50 is sloped, as shown in FIG. 6. Thus, the insertion groove 49 is deeper at the bottom end of the inclined part of the bottom 50 than the other part. In other words, the lock 40 is thinner at this base end than the other part. This thinned portion 52 preferably is a deformation permitting portion.

The female terminal fitting 10 is secured to an end of the wire W, as shown in FIGS. 1 and 2 and is inserted into the corresponding cavity 31 along the inserting direction ID with locking projection 23 faced down. The female terminal fitting 10 is pushed straight so that the stabilizer 27 passes along the guide groove 36. Additionally, the locking projection 23 passes the escaping groove 39 of the elevated portion 38 and then moves onto the insertion groove 49 in the upper surface 44 of the lock 40 at an intermediate stage of the insertion.

Figure 7:
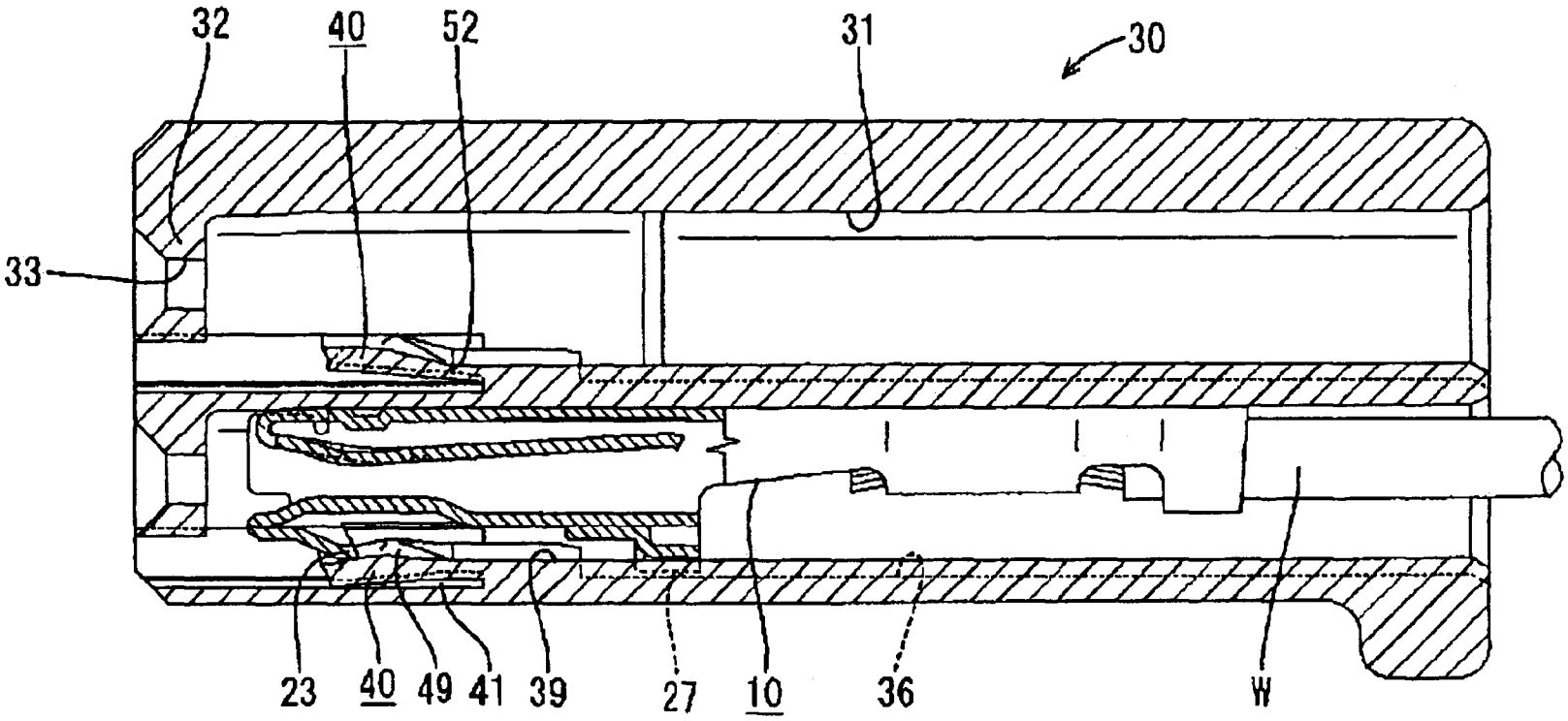
FIG. 7 is a side view in section showing an intermediate stage of insertion of the female terminal fitting.

The female terminal fitting 10 is pushed further along the inserting direction ID. As a result, the locking projection 23 of the female terminal fitting 10 deforms the lock 40 in the deformation direction DD toward the deformation space 41, as shown in FIG. 7. The front part of the locking portion 23 tapers toward the leading end. Thus, the locking projection 23 smoothly passes the insertion groove 49 and deforms the lock 40 in a satisfactory manner.

Figure 8:
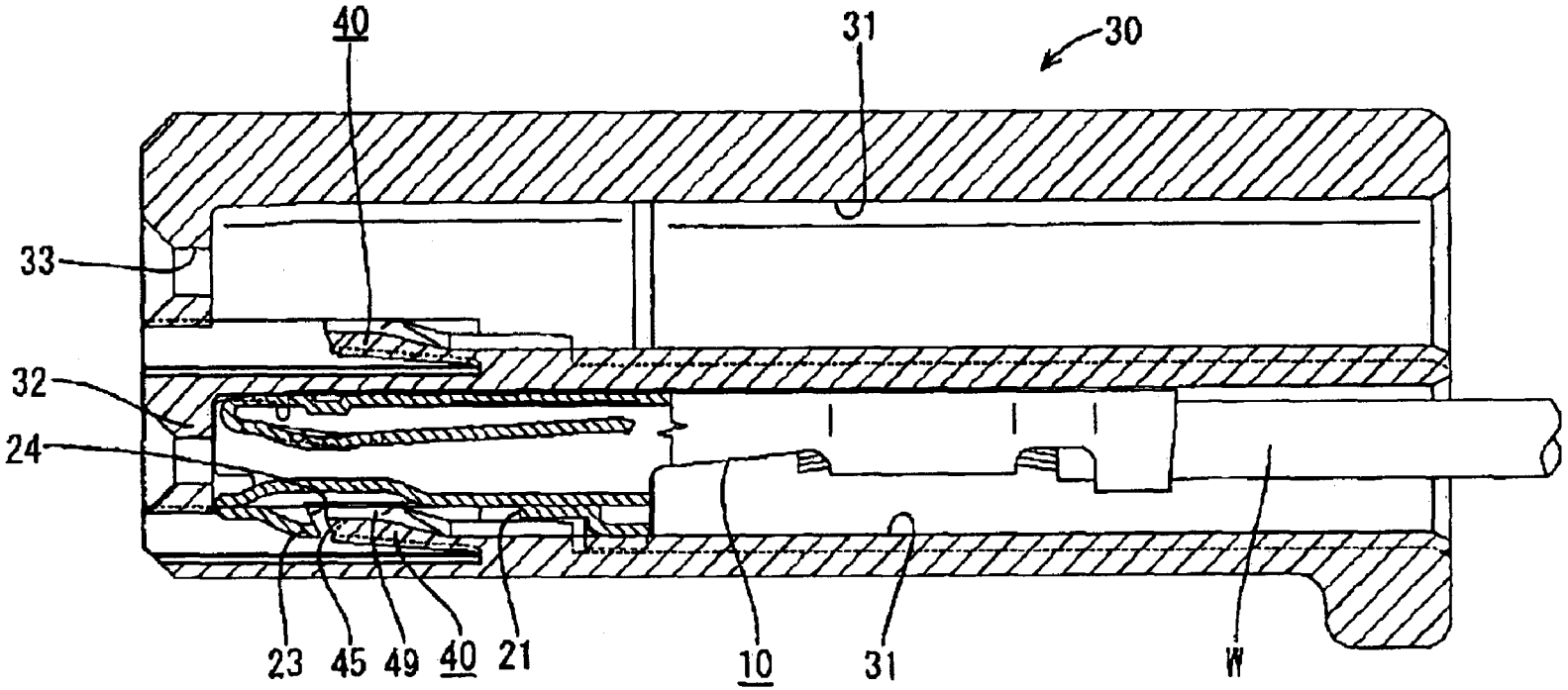
FIG. 8 is a side view in section showing a state where the insertion of the female terminal fitting is completed.
Figure 9:
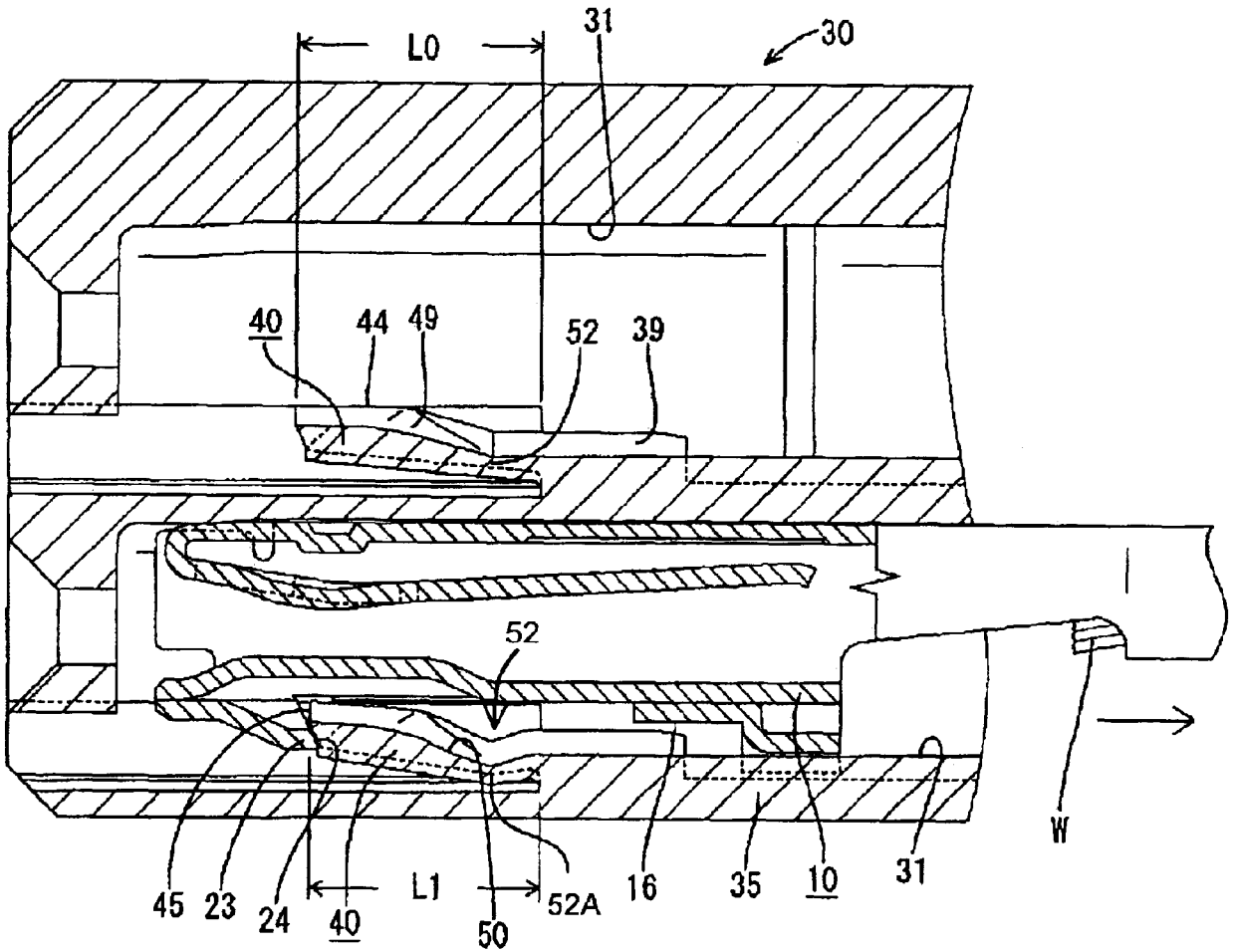
FIG. 9 is a partial enlarged side view in section showing a state where the female terminal fitting is pulled in withdrawing direction.

Sufficient insertion moves the female terminal fitting 10 into contact with the front wall 32 and moves the locking projection 23 over the lock 40. Thus, as shown in FIG. 8, the lock 40 resiliently returns to enter the cut-away portion 21 to lock the female terminal fitting 10. The leading end 45 of the lock 40 engages the locking surface 24, which comprises the rear end surface 23A of the locking projection 23 and the cut end surface 22 of the cut-away portion 21. Thus, the lock 40 has a strong force for locking the female terminal fitting 10.

A force may act on the wire W in the above-described locked state so that the female terminal fitting 10 is pulled backward substantially opposite to the inserting direction ID. Thus, a compressive force acts on the lock 40 substantially in the longitudinal direction. However, the lock 40 can bend or buckle at the thinned portion 52 and undergoes a resilient deformation so that the length of the lock 40 becomes L1, which is shorter than its natural length L0 (see FIG. 9). Buckling strength and the locking force for the female terminal fitting 10 are enhanced by as much as the lock 40 is shortened. Advantageously, the deformation forms a bend 52A along the thinned portion 52 and the bend 52A contacts a corresponding portion of the bottom wall 35 to strut or support the lock 40 thereon.

As described above, the female terminal fitting 10 may be pulled to exert a compressive force on the lock 40 substantially in the longitudinal direction and along the inserting direction ID. The compressive force deforms the lock 40 resiliently and causes the lock 40 to become shorter. As a result, the buckling strength or locking force of the lock 40 is enhanced accordingly. Thus, a sufficient locking force of the lock 40 can be achieved even if the lock 40 is narrowed with the miniaturization of the connector.

Figure 10:
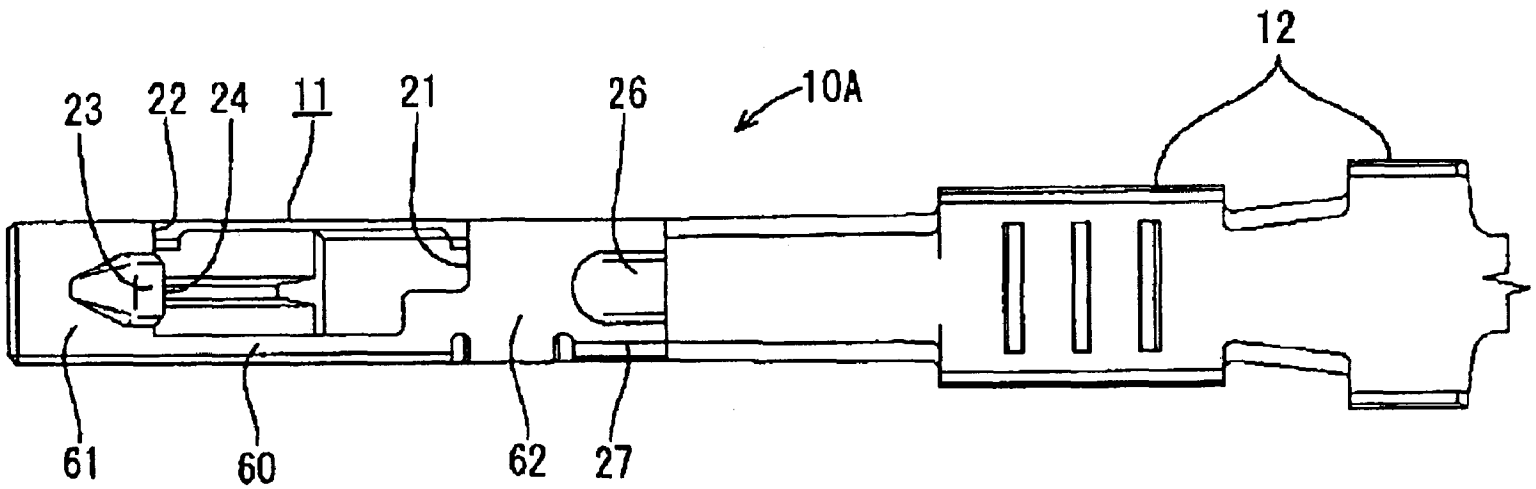
FIG. 10 is a plan view of a female terminal fitting according to a second embodiment of the invention.
Figure 11:
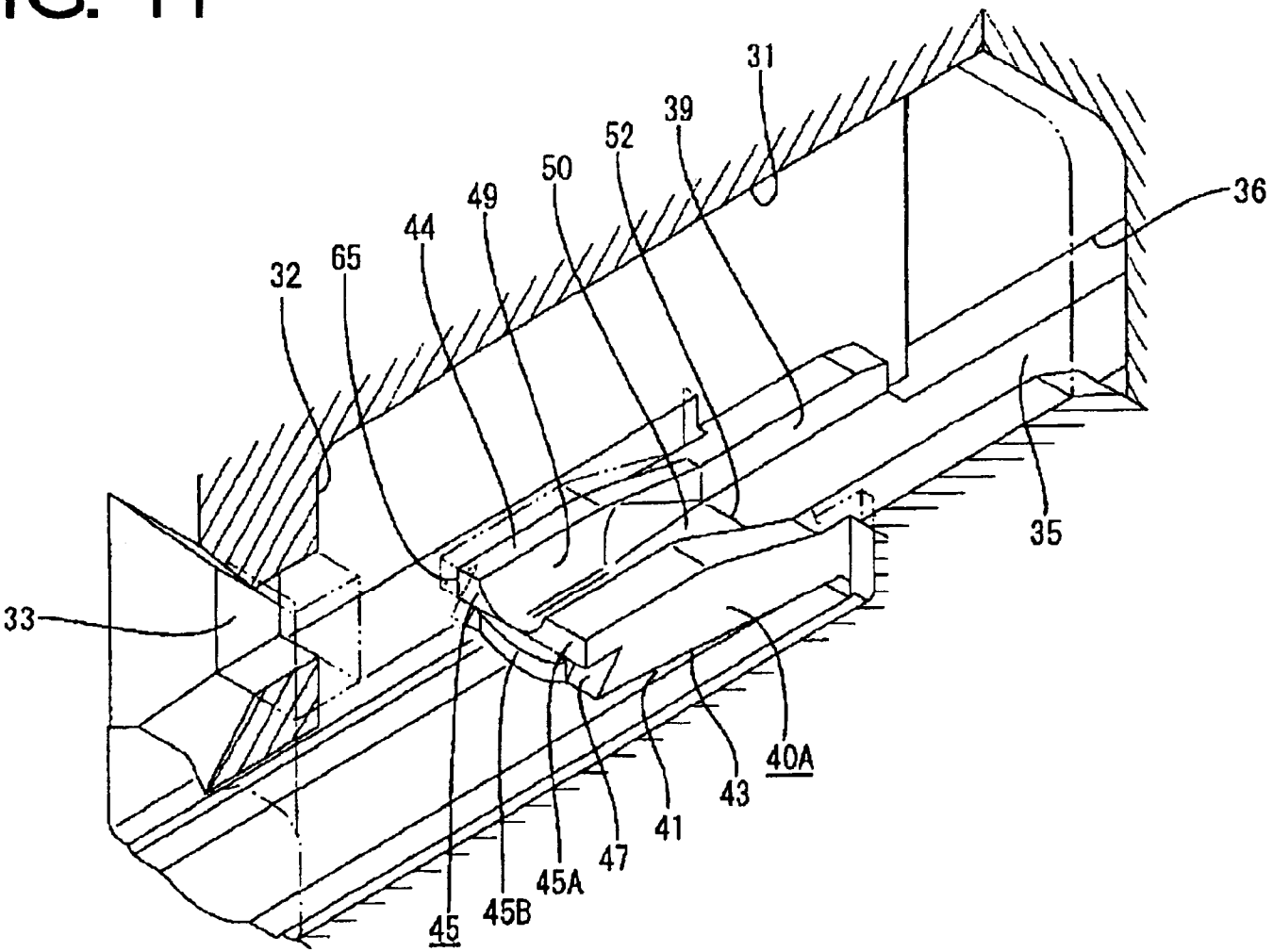
FIG. 11 is a perspective view showing a part where a lock is formed.

FIGS. 10 and 11 show a second embodiment of the invention, which is a modification of the first embodiment.

In the first embodiment, the cut-away 21 extends over the entire width of the outer wall 19 of the ceiling 16 of the female terminal fitting 10 to provide the locking surface 24 that engages the lock 40 in the female terminal fitting 10. This enables the use of both the cut end surface 22 over the entire width of the female terminal fitting 10 and the rear end surface 23A of the locking projection 23 as the locking surface 24, and increases the locking area. On the other hand, the cut-away 21 completely separates the outer wall 19 of the ceiling 16 into front and rear sections. Thus, there is apprehension that the front section engaged with the lock 40 will deform forwardly, and the locking force may be reduced accordingly.

The second embodiment forms a cut-away 21 in a female terminal fitting 10A while leaving one widthwise end of an outer wall 19, as shown in FIG. 10. Thus, sections of the outer wall 19 before and behind the cut-away 21 are connected by a coupling 60 at one side of the outer wall 19. As shown in FIG. 11, a lock 40A is formed with an escaping recess 65 for escaping the coupling 60 by cutting away one side of the leading end. The shape of the lock 40A before cutting is shown by chain line in FIG. 11.

The other construction is similar to or the same as the first embodiment, including the thinned portion 52 for permitting the lock 40A to undergo a resilient deformation to become shorter when a compressive load acts on the lock 40A.

The cut end surface. 22 that forms part of the locking surface 24 is narrower in the second embodiment. However, a front section 61 before the cut-away 21 is coupled to a rear section 62 by the coupling 60. Thus, the front section 61 cannot deform forwardly, and as a result, the locking force is enhanced.

The part of the lock 40A that is narrowed to form the escaping recess 65 is located only at the leading end. The base end of the lock 40A has the original width, which is only slightly narrower than the cavity 31. Therefore, the substantially strength of the lock 40A can be maintained.

The invention is not limited to the above described and illustrated embodiments. For example, the following embodiments are also embraced by the technical scope of the present invention as defined by the claims. Beside the following embodiments, various changes can be made without departing from the scope and spirit of the present invention as defined by the claims.

In the foregoing embodiment, the insertion groove for permitting the passage of the locking projection of the female terminal fitting is formed in the upper surface of the lock and reduces the height of the connector. However, an embodiment with no insertion groove also is embraced by the invention.

The lock may take other shapes, and, for example, may have a locking projection on one surface at its leading end. In short, the invention is widely applicable to locks used so that a compressive load acts in longitudinal direction when a pulling force acts on a terminal fitting in withdrawing direction.

The invention is applicable to male connectors in which male terminal fittings are inserted in male housings.

The thinned portion 52 is provided by forming the bottom 50 of the insertion groove 49 with an inclination that is slightly steeper than the inclination of the lower surface 43 of the lock 40 where the bottom 50 is sloped (as shown in FIG. 6). However, the deformation permitting portion that allows the lock to deform and to become shorter when a compressive load acts on the lock may be provided in a variety of other ways. For example, a portion may be provided with reduced strength or increased resiliency at or around the base of the lock. Such a reduced strength or increased resiliency may be provided by using a different material and/or by reducing a cross-sectional area of the lock at its base end and/or by providing one or more recesses.

What is claimed is:

1. A connector comprising a housing (30) with at least one cavity (31) for receiving a terminal fitting (10; 10A) in an inserting direction (ID), a lock (40; 40A) cantilevered substantially along a longitudinal from a side wall (35) of the cavity (31), the terminal fitting (10; 10A) resiliently deforming the lock (40; 40A) during insertion into the cavity (31) and the lock (40; 40A) being restored to engage and lock the terminal fitting (10; 10A) when the terminal fitting (10; 10A) is inserted by a specified distance, wherein the lock (40; 40A) comprises a deformation permitting portion (52) for permitting such a resilient deformation that a length (L0) of the lock (40; 40A) becomes shorter (L1) when a compressive force acts on the lock (40; 40A) substantially along the longitudinal direction.

2. The connector of claim 1, wherein the lock (40; 40A) is restored to engage the leading end (45) of the lock (40; 40A) with the terminal fitting (10; 10A).

3. The connector of claim 1, wherein the deformation permitting portion (52) comprises a thinner portion (52) at a part of the lock (40; 40A) along the longitudinal direction.

4. The connector of claim 1, wherein a locking projection (23) is formed on a side surface of the terminal fitting (10; 10A) substantially facing the lock (40; 40A) to increase an area of engagement with the lock (40; 40A).

5. The connector of claim 4, wherein the lock (40; 40A) is recessed to form an insertion groove (49) for permitting the passage of the locking projection (23) when the terminal fitting (10; 10A) is inserted while resiliently deforming the lock (40; 40A), the deformation permitting portion (52) being formed by making the insertion groove (49) deeper at one part along the longitudinal direction.

6. The connector of claim 5, wherein the insertion groove (49) is formed to be deeper by setting an inclination of a bottom (50) thereof slightly steeper than that of a surface (43) of the lock (40; 40A) substantially opposite to the surface where the insertion groove (49) is formed.

7. The connector of claim 1, wherein the deformation permitting portion (52) comprises a portion having a reduced cross-sectional area.

8. The connector of claim 1, wherein the deformation permitting portion (52) is provided at a base where the lock (40; 40A) projects from the side wall (35) substantially in the inserting direction (ID).

9. The connector of claim 1, wherein a bent portion (52A) of the deformation permitting portion (52) contacts a corresponding portion of the side wall (35) to strut the lock (40; 40A) thereon when a compressive force acts on the lock (40; 40A) substantially along the longitudinal direction.

10. The connector of claim 1, wherein the terminal fitting (10A) is formed at a wall (19) substantially facing the lock (40; 40A) with a cut-away portion (21) for engaging the lock (40; 40A), sections of the wall (19) before and behind the cut-away portion (21) being connected by a coupling (60) located at one side of the wall (19), and the lock (40; 40A) having an escaping portion (65) for the coupling (60).

11. A connector comprising a housing (30) with opposite front and rear ends and at least one cavity (31) extending between the front and rear ends, the cavity (31) having a side wall (35) and a resiliently deformable lock (40; 40A) cantilevered forwardly in the cavity (31) from the side wall (35), the lock (40; 40A) having a base end at the side wall (35) and a free end (45) remote from the side wall (35), a deformation permitting portion (52) being formed on the lock (40; 40A) near the base end and having a reduced cross-section as compared to other portions of the lock (40; 40A), such that the lock (40; 40A) deforms resiliently at the deformation permitting portion (52) and shortens in response to a compressive force exerted rearwardly on the lock (40; 40A).

12. The connector of claim 11, wherein the lock (40; 40A) is recessed to form a longitudinally extending insertion groove (49), the deformation permitting portion (52) being formed by making the insertion groove (49) deeper at one part along the longitudinal direction.

13. The connector of claim 12, wherein the insertion groove (49) is formed to be deeper by setting an inclination of a bottom (50) thereof slightly steeper than that of a surface (43) of the lock (40; 40A) substantially opposite to the surface where the insertion groove (49) is formed.

14. The connector of claim 11, the deformation permitting portion (52) is configured such that a bent portion (52A) thereof contacts a corresponding portion of the side wall (35) to strut the lock (40; 40A) thereon when a rearward compressive force acts on the lock (40; 40A).

* * * * *